United States Patent [19]

Shikata et al.

[11] 4,364,358

[45] Dec. 21, 1982

[54] AIR-FUEL RATIO CONTROL SYSTEM

[75] Inventors: Makoto Shikata, Musashimurayama; Fujio Matsui, Musashino, both of Japan

[73] Assignees: Fuji Jukogyo Kabushiki Kaisha, Tokyo; Nissan Motor Co., Ltd., Yokohama, both of Japan

[21] Appl. No.: 223,678

[22] Filed: Jan. 9, 1981

[30] Foreign Application Priority Data

Jan. 10, 1980 [JP] Japan ..... 55-1557

[51] Int. Cl.[3] ..... F02B 3/00

[52] U.S. Cl. ..... 123/440

[58] Field of Search ..... 123/440, 489, 492, 493

[56] References Cited

U.S. PATENT DOCUMENTS

| | | | |
|---|---|---|---|
| 4,029,061 | 6/1977 | Asano | 123/440 |
| 4,111,162 | 9/1978 | Norimatsu et al. | 123/440 X |
| 4,119,072 | 10/1978 | Asano | 123/440 |
| 4,129,105 | 12/1978 | Ito et al. | 123/440 |
| 4,143,623 | 3/1979 | Norimatsu et al. | 123/440 |
| 4,153,022 | 5/1979 | Asano et al. | 123/440 |
| 4,163,433 | 8/1979 | Fujishiro | 123/440 |
| 4,167,924 | 9/1979 | Carlson et al. | 123/440 |
| 4,173,952 | 11/1979 | Asano | 123/440 |

*Primary Examiner*—Tony M. Argenbright
*Attorney, Agent, or Firm*—Martin A. Farber

[57] ABSTRACT

A system for controlling the air-fuel ratio for an internal combustion engine having a detector for detecting the concentration of a constituent of exhaust gases passing through the exhaust passage, air-fuel mixture supply device for supplying an air fuel mixture to the induction passage, electromagnetic valves for correcting the air-fuel ratio of the air-fuel mixture supplied by the air-fuel mixture supply device, a comparator for comparing the output signal of the detector with respect to a predetermined value, an integrating circuit having a proportional circuit for integrating the output of the comparator, a driving circuit for driving the electromagnetic valves in dependency upon the output signal of the integrating circuit. The system has a throttle valve switch actuated by the operation of the throttle valve in an idling condition, steady state and full load condition of the engine and a vacuum switch actuated by vacuum pressure in the induction passage of the engine when the throttle valve is opened to a predetermined degree. A switching circuit is provided to change the proportional constant and integrating constant of the integrating circuit and a decision circuit is provided to actuate the switching circuit in dependency on signals from the throttle valve switch and the vacuum switch, whereby the proportional constant and integrating constant may be changed according to the engine operation.

8 Claims, 7 Drawing Figures control circuit
THROTTLE VALVE SWITCH

AIR-FUEL RATIO CONTROL SYSTEM

BACKGROUND OF THE INVENTION

The present invention relates to a system for controlling the air-fuel ratio for an internal combustion engine emission control system with a catalytic converter comprising a three-way catalyst.

Such a control system is a feedback control system, in which the system comprising an $O_2$ sensor for detecting the concentration of oxygen in the exhaust gases, an air-fuel mixture supply unit, an on-off type electromagnetic valve for correcting the air-fuel ratio of the air-fuel mixture supplied by the air-fuel mixture supply unit, and an electronic control circuit. The electronic control circuit comprises a comparator for comparing the output signal of the $O_2$ sensor with a predetermined value, an integrating circuit connected to the comparator for integrating the output of the comparator, and a driving circuit connected to the integrating circuit for producing driving pulses for driving the on-off type electromagnetic valves. The $O_2$ sensor generates an electrical signal as an indication of the air-fuel ratio of the air-fuel mixture induced in the engine cylinder.

The output voltage of the $O_2$ sensor is higher than a predetermined voltage when the oxygen concentration of the exhaust gases is smaller than a predetermined ratio corresponding to the stoichiometric air-fuel ratio in the air-fuel mixture for the combustion of the mixture and is lower than the predetermined voltage when the oxygen concentration is greater than the predetermined ratio. The duty ratio of the driving pulse varies in dependency on the output of the integrating circuit to control the air-fuel ratio of the mixture to be supplied to the cylinder to the stoichiometric air-fuel ratio.

In order to control exactly the air-fuel ratio, it is desirable to provide detecting means which may detect the engine operation in the idling operation, the steady state operation and the wide open throttle condition and to provide a control circuit for controlling the circuit constant of the feedback control circuit in accordance with the engine operation.

SUMMARY OF THE INVENTION

The object of the present invention is to provide an electronic control system which may exactly detect the engine operation and control the constant of the feedback control circuit in accordance with the engine operation. Another object of the present invention is to provide a detecting system which has a simple composition and may detect the idling operation, steady state operation and full load operation of the engine.

Other objects and features of the present invention will become apparent from the following description with reference to the accompanying drawings.

DETAILED DESCRIPTION OF THE PREFERRED EMBODIMENT

Figures 1, 3:
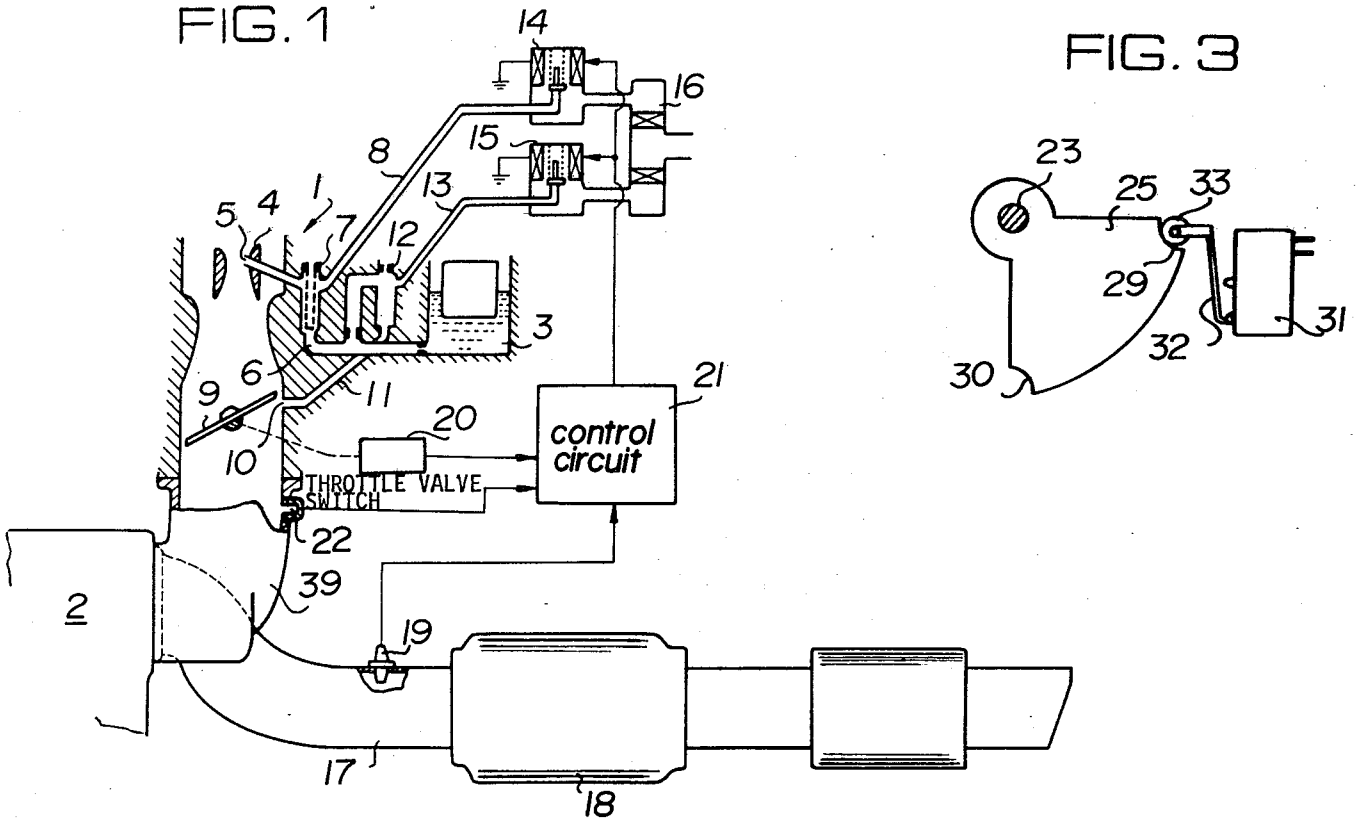
FIG. 1 is a schematic view of a system for controlling air-fuel ratio according to the present invention.
FIG. 3 is a front view of the throttle switch portion.

Referring to FIG. 1, a carburetor 1 communicates with an internal combustion engine 2. The carburetor comprises a float chamber 3, a venturi 4, a nozzle 5 communicating with the float chamber 3 through a main fuel passage 6, and a slow port 10 communicating with the float chamber 3 through a slow fuel passage 11. Air correcting passages 8 and 13 are provided in parallel to a main air bleed 7 and a slow air bleed 12, respectively. On-off type electromagnetic valves 14 and 15 are provided for the air correcting passages 8 and 13, respectively. An inlet port of each on-off electromagnetic valve communicates with the atmosphere through an air cleaner 16. An $O_2$ sensor 19 is provided on an exhaust pipe 17 upstream of a three-way catalyst converter 18 for detecting the oxygen concentration of exhaust gases.

A throttle valve switch 20 is provided to detect the opening degree of a throttle valve 9. Further, a vacuum switch 22 is provided in the induction passage 39 for detecting the vacuum pressure in the induction passage. Output signals of $O_2$ sensor 19, and switches 20 and 22 are sent to an electronic control circuit 21 for actuating the on-off type electromagnetic valves 14 and 15 to control the air-fuel ratio of the mixture to a value approximately equal to the stoichiometric air-fuel ratio.

Figure 2:
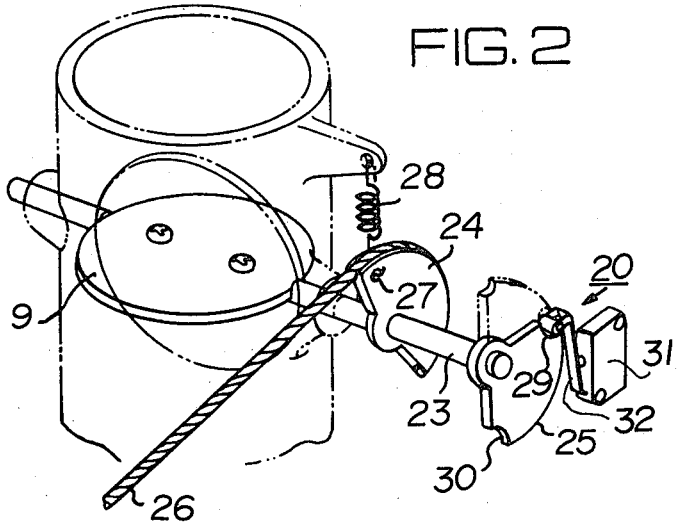
FIG. 2 is a perspective view showing a throttle lever and throttle switch portion.

Referring to FIG. 2, a throttle lever 24 and a switch actuating plate 25 are secured to a pivot shaft 23 of the throttle valve 9. The throttle lever 24 is connected to an accelerator pedal through an accelerator cable 26 and biased by a spring 28 to close the throttle valve. Referring to FIG. 3, the switch actuating plate 25 has a sector shape and notches 29 and 30 at opposite ends of the plate. The throttle switch 20 comprises a microswitch 31 having a roller 33 provided on a switch actuating lever 32. The roller 33 is adapted to engage with the notch 29 in the idling position of the throttle valve 9 and to engage with the notch 30 at the wide open throttle position and to engage with the arc portion of the plate 25 therebetween both of these throttle positions.

Figure 4:
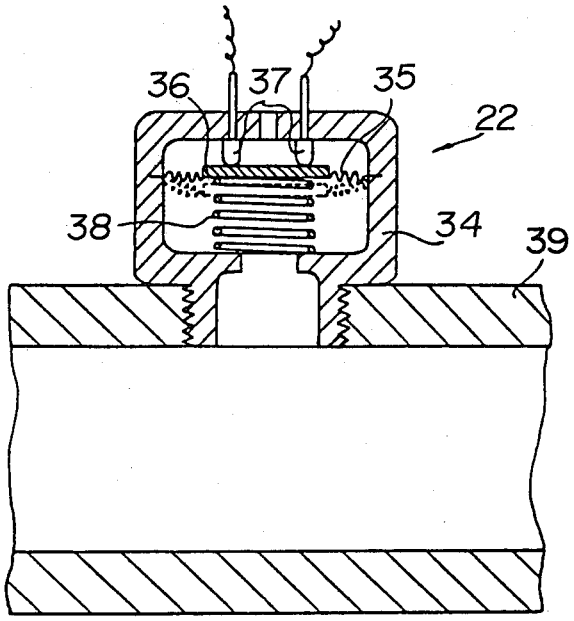
FIG. 4 is a sectional view showing a vacuum switch.

Referring to FIG. 4, the case 34 of the vacuum switch 22 communicates with the induction passage 39 and is separated by a diaphragm 35 into two chambers. The diaphragm 35 has a contact plate 36 which is pressed against a pair of contacts 37 by a spring 38. Thus, when the vacuum pressure is low, that is the throttle valve 9 is fully opened for a heavy load, the contacts 37 are connected by the contact plate 36. When the vacuum pressure is high (small opening of the throttle valve for a light load), the diaphragm 35 is deflected by the vacuum, so that the contacts 37 are cut off.

Figure 5:
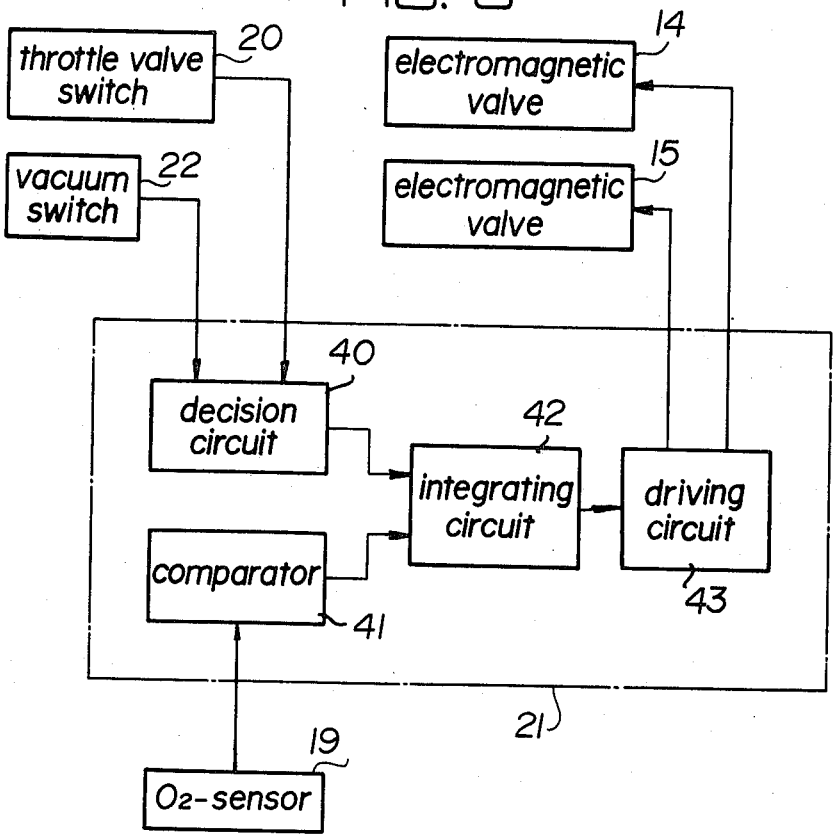
FIG. 5 is a block diagram of an electronic control circuit according to the present invention.
Figure 7:
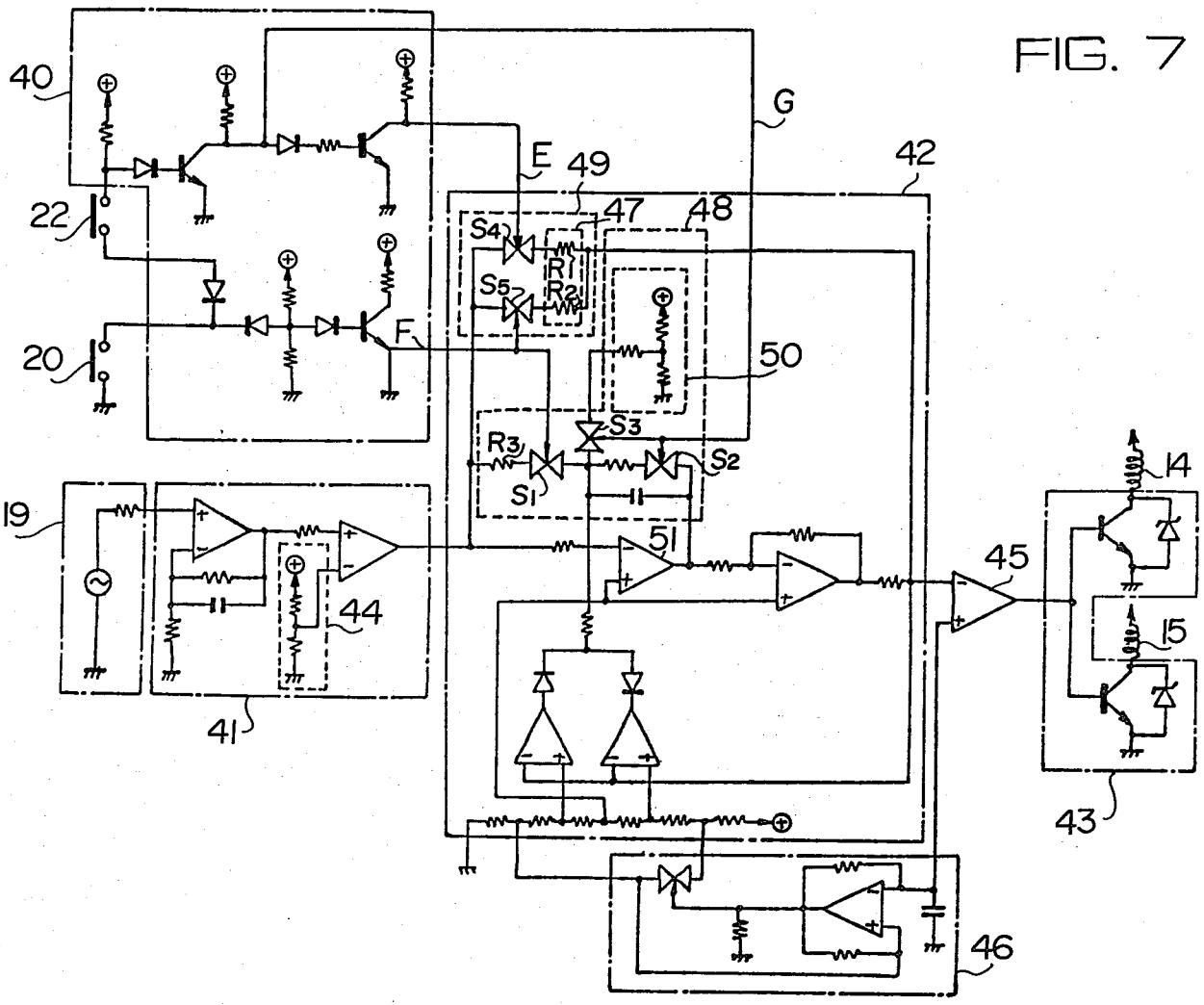
FIG. 7 shows an example of the electronic control circuit.

Referring to FIGS. 5 and 7, the output signal of the $O_2$ sensor 19 is fed to a comparator 41. The comparator 41 operates to compare the input signal with a set value applied from a set value circuit 44 (FIG. 7) to produce a deviation signal. The deviation signal is fed to an integrating circuit 42 having a proportional circuit 47, so that the deviation signal is converted into a proportional and integrating signal. The proportional and integrating signal is fed to a comparator 45 which compares it with triangular pulses fed from a triangular wave pulse generator 46, so that square wave pulses are produced. The square pulses are fed to a driving circuit 43 and further to both of the on-off type electromagnetic valves 14 and 15. On the other hand, the throttle switch 20 and the vacuum switch 22 are connected to a decision circuit 40. The judging circuit 40 operates to determine the operating condition of the engine and produces an output signals which are applied to the integrating circuit 42.

The integrating circuit 42 is provided with means for controlling the circuit constant such as an integrating constant control device 48 and proportional constant control device 49.

Figure 6:
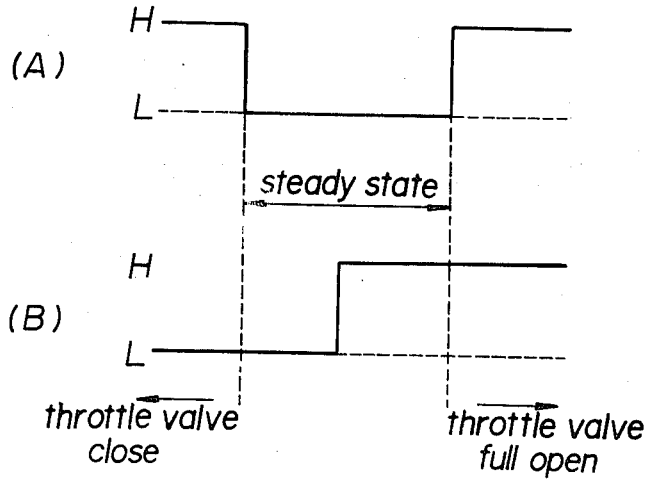
FIG. 6 shows a graph of outputs of the throttle switch and the vacuum switch.

In operation, when the engine is in an idling condition, that is the throttle valve 9 is closed as shown in FIG. 2, the roller 33 engages in the notch 29 of the switch actuating plate 25, thereby closing the throttle switch 20, namely the microswitch 31. At this time, the vacuum pressure in the induction passage 39 is high, so that the vacuum switch 22 is opened. When the accelerator pedal is depressed, the throttle valve 9 is opened through the accelerator cable 26. Thus, the roller 33 rides on the higher portion of the switch actuating plate 25 thereby opening the throttle switch 20. In the steady state, the vacuum switch 22 is opened or closed according to the variation of the vacuum pressure in the induction passage 39. When the throttle valve is fully opened, the throttle switch 20 microswitch 31 is closed by engagement of the roller 33 with the notch 30. In this state, since the vacuum pressure in the induction passage 39 is low, the vacuum switch 22 is closed. If the closing signal of the vacuum switch 22 is designated "H" and opening signal of the vacuum switch 22 is "L", operations of both switches 20 and 22 may be illustrated as in FIG. 6, in which (A) shows the operation of the throttle switch 20 and (B) shows that of the vacuum switch 22.

By adding the signals of both switches, it is possible to determine the condition of the engine operation. The following table shows the relation between the signals of both switches and the engine operation.

| | | | |
|---|---|---|---|
| Throttle switch 20 | H | L | H |
| Vacuum switch 22 | L | L or H | H |
| Engine Operation | Idling | Steady State | Full Load |

In the system of the present invention, the circuit constant is changed in dependency on the engine operation determined by the signals from the switches 20 and 22. The operation of the system will be more fully described with reference to FIG. 7. In the idling condition, the throttle switch 20 is closed and the vacuum switch 22 is opened, so that output E of the decision circuit 40 is high, output F is low and output G is low. Thus, a semiconductor switch $S_4$ is closed and semiconductor switches $S_1$, $S_2$, $S_3$ and $S_5$ are opened. Therefore, a small proportional constant is given by a greater resistor $R_1$ and the integrating constant is small. In this manner an air-fuel ratio control suitable for the idling operation is provided. In the steady state, the throttle switch 20 is opened, so that the output F changes to a high level. Thus, the switches $S_1$ and $S_5$ are closed and hence the proportional constant and integrating constant change to a greater value with resistors $R_1$, $R_2$ and $R_3$. When the throttle valve 9 is fully opened, the throttle switch 20 is closed and the vacuum switch 22 is in closed state. Therefore, the output E goes to a low level, the output F goes to a low level and the output G changes to a high level. Thus, switches $S_1$ and $S_5$ are opened and switches $S_2$ and $S_3$ are closed. Accordingly, the integration does not operate and a fixed voltage is applied from a fixed voltage supply circuit 50 to the operational amplifier 51 through the switch $S_3$. Thus, a fixed output voltage is fed to the comparator 45, so that a pulse train having a constant duty ratio is generated. Therefore, the on-off electromagnetic valves 14 and 15 operate at a fixed duty ratio.

From the foregoing, it will be understood that air-fuel ratio may be exactly controlled according to the engine operation. Since the throttle switch is made by only one microswitch, the system is simple in construction.

What is claimed is:

1. In a system for controlling the air-fuel ratio for an internal combustion engine having an induction passage leading to the engine, an exhaust passage from the engine, a throttle valve in the induction passage, detecting means for detecting the concentration of a constituent of exhaust gases passing through said exhaust passage, air-fuel mixture supply means for supplying air-fuel mixture to the induction passage, electromagnetic valve means for correcting the air-fuel ratio of the air-fuel mixture supplied by said air-fuel mixture supply means, comparator means for comparing the output signal of said detecting means with a predetermined value, integrating circuit means having an integrating circuit for integrating the output of said comparator means, and driving circuit means for driving said electromagnetic valve means in dependency upon the output signal of said integrating circuit means, the improvement comprising a throttle valve switch, a first means operatively connecting said throttle valve switch to said throttle valve for actuating said throttle valve switch in dependency on the position of said throttle valve, a vacuum switch, a second means communicating with said induction passage so as to be operated by the vacuum pressure in said induction passage for actuating said vacuum switch when said throttle valve is opened to a predetermined degree, switching circuit means for changing the circuit constant of said integrating circuit, and decision circuit means responsive to operations of said throttle valve switch and said vacuum switch for actuating said switching circuit means, so that said circuit constant is changed in a steady state of the engine compared with idling operation.

2. A system for controlling the air-fuel ratio for an internal combustion engine according to claim 1 wherein said first means is adapted to switch said throttle valve switch in idling operation steady state and full load condition of said engine.

3. A system for controlling the air-fuel ratio for an internal combustion engine according to claim 1, wherein said integrating circuit means has a means for supplying a fixed voltage, said decision circuit means is for controlling said switching circuit means such that a proportional constant and the integrating circuit constant of said integrating circuit, of said integrating circuit means are decreased in the idling operation and increased in the steady state of the engine and the integrating operation is not effected and the fixed voltage is supplied to said driving circuit means in the full load condition of said engine via said supplying means.

4. The system as set forth in claim 1, wherein said decision circuit means is for actuating said switching circuit means such that said circuit constant is increased in the steady state of the engine compared with idling operation.

5. The system as set forth in claim 4, wherein said throttle valve switch is a two position switch which has an open and closed position, said throttle valve switch being closed in idling operation and full load condition and open in the steady state, said vacuum switch is a two position switch which has an open and closed position, said vacuum switch being closed in the full load condition and open in the idling operation.

6. The system as set forth in claim 4 or 5, wherein said integrating circuit includes an operational amplifier and a capacitor operatively connected to said amplifier, said switching circuit means includes an integration constant control means comprising a first switch and a first resistor in series therewith, said first switch and said first resistor together being connected in parallel to said capacitor, a fixed voltage supplying circuit means, and a second switch connected between said fixed voltage supplying circuit means and said capacitor, said decision circuit means has an output responsive to the operation of said vacuum switch and said throttle valve switch for simultaneously controlling said first and said second switches and closing said switches when said vacuum switch and said throttle valve switch are closed and opening said switches when at least one of said throttle valve switch and said vacuum switch are opened.

7. The system as set forth in claim 6, wherein said integration constant control means includes a third switch and a second resistor in series therewith, said third switch is connected between a junction between said first and second switches and said second resistor, the latter being connected between an input of said operational amplifier and said comparator means, said decision circuit means has another output responsive to the operation of said throttle valve switch and for closing said third switch when said throttle valve switch is opened and for opening said third switch when said throttle valve switch is closed.

8. The system as set forth in claim 7, wherein said decision circuit means includes said vacuum switch and said throttle valve switch, and a diode connecting said vacuum switch is series with said throttle valve switch.

* * * * *